United States Patent [19]

Theroux

[11] Patent Number: 5,053,683

[45] Date of Patent: Oct. 1, 1991

[54] STARTING AND OPERATING DEVICE FOR CONTROLLING A STARTER THAT IGNITES A SODIUM LAMP

[75] Inventor: Luc Theroux, Montreal, Canada

[73] Assignee: Lendar Design Inc., St-Basile-le-Grand, Canada

[21] Appl. No.: 623,230

[22] Filed: Dec. 6, 1990

[51] Int. Cl.[5] ..... H05B 37/00; H05B 39/00; H05B 41/36; G05F 1/00

[52] U.S. Cl. ..... 315/290; 315/DIG. 7; 315/360; 315/307; 315/308

[58] Field of Search ..... 315/289, 290, 360, 208, 315/DIG. 7, 225, 307, 308

[56] References Cited

U.S. PATENT DOCUMENTS

| | | | |
|---|---|---|---|
| 4,437,042 | 3/1984 | Morais et al. | 315/289 |
| 4,473,779 | 9/1984 | Lindner et al. | 315/119 |
| 4,763,044 | 8/1988 | Nuckolls et al. | 315/176 |
| 4,810,936 | 3/1989 | Nuckolls et al. | 315/119 |
| 4,853,599 | 8/1989 | Singarayer | 315/119 |
| 4,896,077 | 1/1990 | Dodd et al. | 315/289 |
| 4,962,336 | 10/1990 | Dodd et al. | 315/290 |
| 4,996,464 | 2/1991 | Dodd et al. | 315/289 |

*Primary Examiner*—Eugene R. LaRoche
*Assistant Examiner*—Michael B. Shingleton
*Attorney, Agent, or Firm*—Collard, Roe & Galgano

[57] ABSTRACT

A starting and operating device for controlling a starter that ignites a sodium lamp, AC power voltage being provided to the starter and sodium lamp by means of a power supply transformer having its secondary winding connected to the starter and sodium lamp, and its primary winding connected to an AC power source. The device comprises an AC/DC converter connected to the primary winding for converting AC voltage into a low DC voltage; a high power disabling device for disabling the starter; an optor-isolator connected to the high power disabling device for controlling the high power disabling device by means of a low DC signal, and for electrically isolating the high power disabling device; a timer connected to the opto-isolator for generating the low DC signal after passage of a predetermined amount of time to disable the starter; and a first delay circuit connected to the AC/DC converter for detecting energizing of the AC/DC converter, and for generating a delayed resetting signal for the timer after detection of the energizing whereby the AC/DC converter can be stabilized before resetting the timer.

5 Claims, 4 Drawing Sheets

STARTING AND OPERATING DEVICE FOR CONTROLLING A STARTER THAT IGNITES A SODIUM LAMP

BACKGROUND OF THE INVENTION

The present invention relates to a starting and operating device for controlling the starter that ignites a sodium lamp.

Known in the art, there is the U.S. Pat. No. 4,896,077 of Peter G. DODD, granted on Jan. 23, 1990. This patent describes an ignitor disabler for disabling the ignitor of a high intensity discharge lamp. This ignitor disabler monitors the operating or characteristic voltage of the lamp.

This ignitor disabler comprises means for disabling the igniting portion during abnormal lamp operation; means for triggering the means for disabling after passage of a predetermined amount of time, the means for triggering having a timing component for measuring the predetermined amount of time, which timing component begins time measuring operation only under certain predetermined conditions; means for resetting the timing component of the means for triggering upon lamp ignition; and means for establishing a threshold voltage that is higher than the characteristic voltage of the lamp under normal operating conditions. An object of this invention is to provide a unit that is substantially independent of the ballast/ignitor and can therefore be used in conjunction with any standard ballast/ignitor currently commercially available for these lamps.

Even if the problem of providing a unit that is substantially independent of the ballast is specifically aimed in this patent, this goal is not substantially reached because the power supply of the disabler described in this patent is designed to convert alternating current from the ballast secondary winding to direct current. As there are different ballasts operating at different powers on the market, the voltage available at the ballast secondary winding varies from one ballast to another. Therefore, the object of providing a unit that is independent of the ballast is not reached by this circuit.

Also known in the art, there are the U.S. Pat. No. 4,853,599 of Santiago SINGARAYER, the U.S. Pat. No. 4,473,779 of Larry A. LINDNER and the U.S. Pat. Nos. 4,810,936 and 4,763,044 of Joe. A. NUCKOLLS that provide different circuits that can be used for protecting the ballast-starter of a high intensity lamp. One of the drawbacks with the above-mentioned patents resides in the fact that all of these devices cannot be used in conjunction with different ballast-starters commercially available on the market.

OBJECT OF THE INVENTION

It is an object of the present invention to provide a starting and operating device that can be used in conjunction with different ballast-starters currently commercially available for sodium lamps.

SUMMARY OF THE INVENTION

According to the present invention there is provided a starting and operating device for controlling a starter that ignites a sodium lamp, AC power voltage being provided to said starter and sodium lamp by means of a power supply transformer having its secondary winding connected to said starter and sodium lamp, and its primary winding connected to an AC power source, said device comprises:

an AC/DC converter connected to said primary winding for converting AC voltage into a low DC voltage;

a high power disabling means for disabling said starter;

an optor-isolator connected to said high power disabling means for controlling said high power disabling means by means of a low DC signal, and for electrically isolating said high power disabling means;

a timer connected to said opto-isolator for generating said low DC signal after passage of a predetermined amount of time to disable said starter; and a first delay circuit connected to said AC/DC converter for detecting energizing of said AC/DC converter, and for generating a delayed resetting signal for said timer after detection of said energizing whereby said AC/DC converter can be stabilized before resetting said timer.

The objects, advantages and other features of the present invention will become more apparent upon reading of the following non-restrictive description of a preferred embodiment thereof, given for the purpose of exemplification only with reference to the accompanying drawings.

DETAILED DESCRIPTION OF THE DRAWINGS

Figure 1:
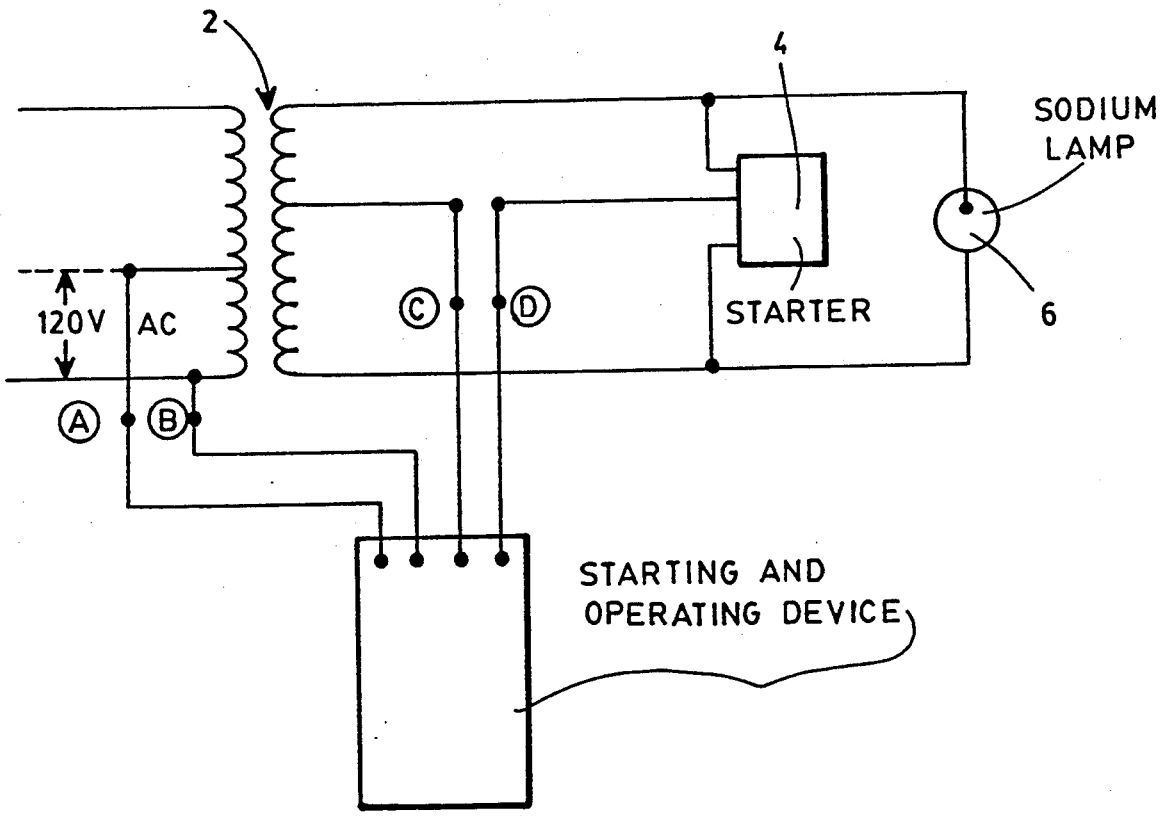
FIG. 1 is a schematic diagram partially in block diagram illustrating how the present invention is connected to a conventional sodium lamp system.

Referring now to FIG. 1, there is shown how the present device is connected to a conventional sodium lamp system. A conventional sodium lamp system comprises is a ballast constituted of a transformer 2, a starter 4 which generates high voltage pulses, and a sodium lamp 6 which is ignited by the high voltage pulses provided by the starter 2. Normally, the starter 4 generates high voltage pulses until the sodium lamp is ignited. But if for a reason or another the sodium lamp 6 is not ignited, damages can be done to the starter 4 and the transformer 2 by overheating.

As it can be seen on FIG. 1, the starting and operating device according to the present invention is connected, on the one hand to the primary winding of the transformer 2 by means of the connections A and B, and,on the other hand, to the starter 4 by means of the connections C and D. As it can be seen, contrary to what is taught in the prior art, the device is not connected to the secondary winding of the transformer 2 which constitutes the ballast but to the primary winding.

This aspect of the invention is important because the primary winding of a ballast provides, almost all the time, a 120 AC voltage connection tap, which is not the case at the secondary winding that provides an AC voltage varying with the power of the sodium lamp.

The present starting and operating device allows energizing of the starter 4 only during a predetermined time period that is necessary for igniting the sodium lamp 6. Thus, when the AC power voltage is applied to the primary winding of the ballast 2 or when a temporary failure of the AC power voltage occurs at the primary winding of the ballast 2, the starter starts to generate high voltage pulses and a timer is resetted. After the predetermined time period which is preferably two minutes and sixteen seconds, the starter 4 is deactivated even if the sodium lamp 6 is not turned on.

Figure 2:
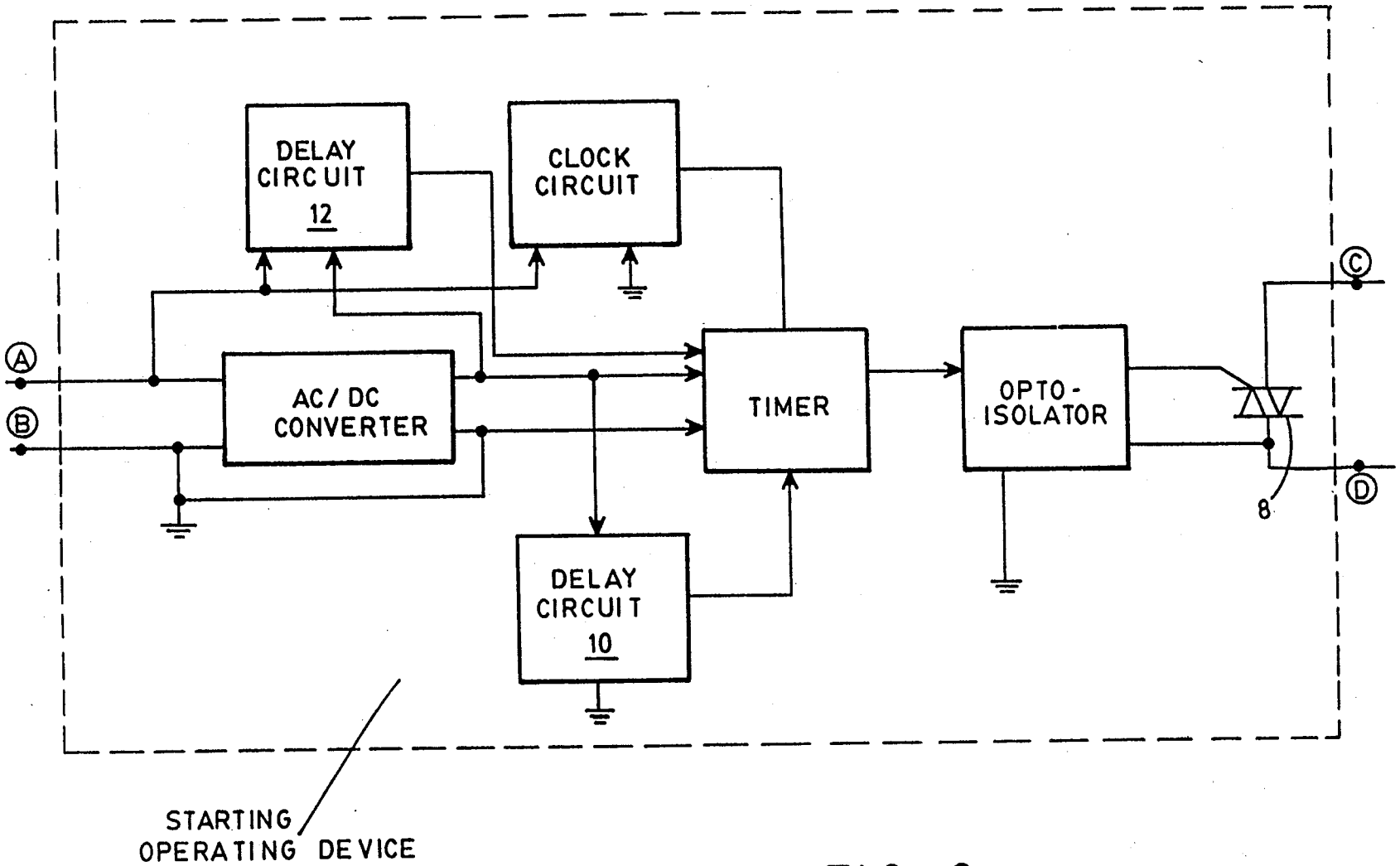
FIG. 2 is a block diagram illustrating a particular embodiment of a device according to the present invention.

Referring now to FIG. 2, there is shown a block diagram illustrating the present starting and operating device for controlling the starter that ignites the sodium lamp. The device comprises an AC/DC converter connected to the primary winding of the ballast by means of the connections A and B for converting AC voltage into a low DC voltage; a high power disabling means 8 connected to the starter by means of the connections C and D for disabling it; an opto-isolator connected to the high power disabling means 8 for triggering it by means of a low DC signal, and for electrically isolating it; a timer connected to the opto-isolator for generating the low DC signal after passage of a predetermined amount of time; a first delay circuit 10 for generating a delayed resetting signal for the timer after energizing of the device; and a clock circuit for providing a clock to the timer.

When the AC power source voltage is applied to the primary winding of the ballast, the starter starts to generate high voltage pulses until the moment when the high power disabling means 8 disables it after the passage of the predetermined amount of time. The device further comprises a second delay circuit 12 having an input connected to the primary winding of the ballast by means of the connections A and B for detecting a temporary failure of the AC power source, and an output connected to the timer for generating a delayed resetting signal for the starter after detection of the temporary failure.

When the AC power source drops or misses several AC power cycles, the lamp can be turned off, and the starter must be reactivated for the predetermined amount of time. The resetting of the timer and reactivation of the starter cannot be done by the first delay circuit because the temporary failure of the AC power source is usually too short for allowing a significant voltage drop at the output of the AC/DC converter. As the first delay circuit provides a resetting signal by detecting a voltage drop at the output of the AC/DC converter, it would not detect the temporary failure. Thus, after a temporary failure of the AC power supply, a resetting is done by the second delay circuit.

The clock circuit provides a series of 60 Hz, squared shaped pulses having an amplitude −15 volts. These clock pulses are induced from the 60 hz, 120 volts AC power supply. These clock pulses are used as time base for the timer.

The AC/DC converter provides the low DC voltage power supply necessary for energizing the different elements of the present device from the 120 volts AC power supply provided at the primary winding of the ballast. Please note that no transformer is used for dropping the AC voltage supplied by the primary winding. For dropping and rectifying the AC voltage, a SCR device is used. The trigger of the SCR device is triggered at a specific angle during one portion of the negative alternation to simultaneously drop and rectify the AC voltage.

The first delay circuit delays the resetting of the timer after that the AC voltage is applied to the AC/DC converter to make sure that the output of the converter is stable before triggering the predetermined amount of time at the timer. Please note that the delayed resetting signal generated by the first delay circuit is not generated unless the −15 volts at the output of the AC/DC converter drops at least to −3 volts.

The opto-isolator allows the use by the present device of a 120 volts AC power supply independent from the power supply of the starter. Also, the opto-isolator provides a 0 volt commutation so that the lamp and the high power disabling means can last much longer. The opto-isolator cannot support the pulses generated by the starter therefore a high power disabling means which is a triac must be connected to the opto-isolator for controlling the starter.

Figure 3:
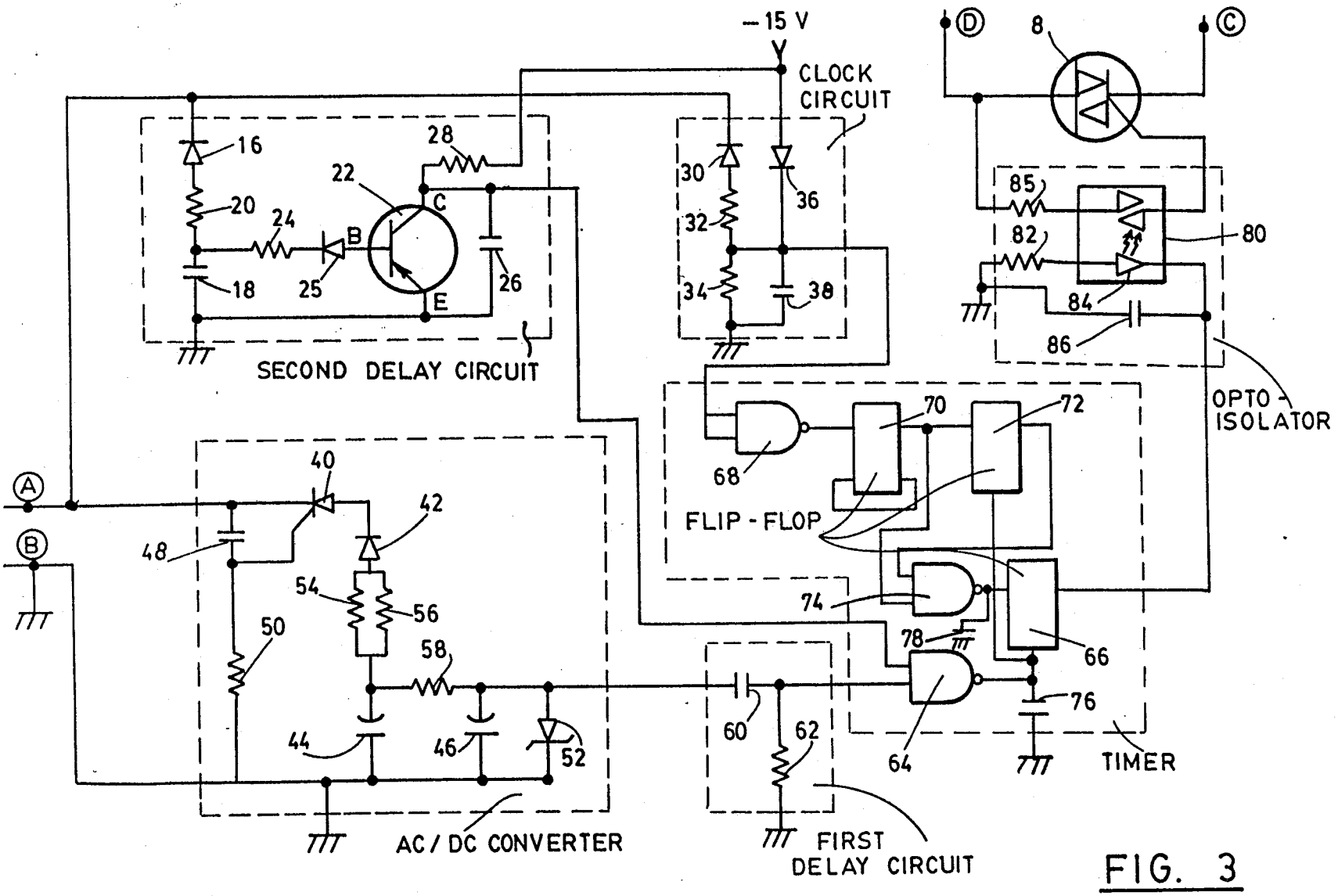
FIG. 3 is a detailed diagram illustrating the device shown in FIG. 2.

Referring now to FIG. 3, the second delay circuit comprises a diode 16 for rectifying the negative alternation of the 60 Hz AC power voltage, and charging the capacitor 18 through the resistor 20. When the capacitor 18 is charged, the transistor 22 conducts so that its collector is maintained at zero volt which is a 1 level. If there is a temporary failure of the AC power supply, the diode 16 forms an open circuit and the capacitor 18 is discharged through the resistor 24 and the diode 25. When the voltage across the capacitor 18 drops below 1.4 volts, the transistor 22 is blocked, and the voltage at its collector drops to −15 volts which is a 0 level. When the AC power supply returns to normal operating conditions, then the capacitor 18 is charged, eventually the transistor 22 conducts again to produce a 1 level at its collector whereby a delayed resetting signal is generated. The capacitor 26 is used for filtering the noise generated by the starter, and the resistor 28 is used for limiting the current through the transistor 22.

Referring now to the clock circuit, the diode 30 rectifies the negative alternation of the 60 Hz AC power supply. The resistors 32 and 34 form a voltage divider. The diode 36 limits the voltage at the connection between the resistors 32 and 34 to −15 volts. This clock circuit produces square shaped pulses varying from 0 volt to −15 volts at the connection between the resistors 32 and 34. The capacitor 38 is used for filtering the noise produced by the starter.

The AC/DC converter produces a low DC voltage induced from the 120 volts AC voltage provided at the primary winding of the ballast by controlling the angle of conduction of the SCR device 40. Only the last portion of the negative alternation is triggered by the SCR device 40. During the positive alternation of the AC voltage, the SCR device 40 and the diode 42 are blocked and the output of the AC/DC converter is stabilized by means of the capacitors 44 and 46 which have been charged during precedent negative alternations. At the beginning of a negative alternation, the capacitor 48 is discharged so that the voltage between the gate and the cathode of the SCR device 40 is not sufficient for allowing conduction of the SCR device 40. The capacitor 48 is slowly charged through the resistor 50 and when the voltage across the capacitor 48 is sufficiently high, the SCR device 40 and the diode 42 conduct thus allowing a charge of the capacitors 44 and 46. The voltage across the capacitor 46 is regulated by the zener diode 52. The resistors 54, 56 and 58 limit the current across the zener diode 52.

Referring now to the first delay circuit, it can be easily understood that before resetting the timer, the output of the AC/DC converter must be stabilized. Thus, after that the AC voltage is applied to the connections A and B, the voltage across the capacitor 60 and the resistor 62 is −15 volts so that a 0 level is applied to the NAND gate 64 and a 1 level is applied to the reset input of the flip-flop 66. Then, the capacitor 60 is charged across the resistor 62. When the voltage across the resistor 62 reaches zero volt, a delayed 1 level is applied to the NAND gate 64 to reset the flip-flop 66.

The 60 Hz square shaped pulses generated by the clock circuit are applied to a NAND gate 68 with SCHMIT trigger to adapt these square shaped pulses to CMOS circuits. The 60 Hz square shaped pulses generated by the NAND gate 68 are divided by two by the flip-flop 70 so that a better choice of outputs on the 12 bits counter formed by the flip-flop 70 and the counter 72 is provided, and a symmetrical signal is obtained. Then, the output of the flip-flop 70 is divided by 12 by the counter 72 so that a delay of 2 minutes and 16 seconds can be provided at the output of the counter 72. A resetting of the flip-flop 66 and the counter 72 is always done after that the AC power supply voltage is applied to the connections A and B or after a temporary failure of the AC power voltage. The output of the flip-flop 66 controls the starter by means of the opto-isolator which is an opto-triac 80, and by means of the high power disabling means 8 which is a power triac. The flip-flop 66 changes its output when the counter formed of the flip-flop 70 and the counter 72 reaches its predetermined value. Obviously, the output of the counter 72 is synchronized with the clock circuit.

When a resetting signal is sent to the flip-flop 66, the starter is activated to turn on the lamp. The output of the flip-flop 66 maintains its state as long as a pulse is not applied to its clock input. After the predetermined amount of time of 2 minutes and 16 seconds, a pulse is applied to the input clock of the flip-flop 66 to change its output. This pulse is produced by a NAND gate 74 which has its two inputs connected respectively to the outputs of the flip-flop 70 and the counter 72. When the flip-flop 66 changes its output, the starter is deactivated. The capacitors 76 and 78 are used to filter the noise generated by the starter.

The opto-isolator comprises the opto-triac 80 connected to the output of the flip-flop 66 of the timer. This opto-triac 80 controls the power triac 8. The power triac 8 must be used because the opto-triac cannot support the pulses generated by the starter. The resistor 82 limits the current across the diode 84 of the opto-triac 80, and the resistor 85 limits the current across the gate of the power triac 8. The capacitor 86 is used to filter the noise.

Several advantages are provided by the preferred embodiment described above. First, the use of the 120 volts AC power supply provided at the primary winding of the ballast provides a starting and operating device that can be used in conjunction with different ballast-starters currently commercially available for sodium lamps. Second, the use of a timer having its time base induced from the 60 Hz AC voltage provides a predetermined amount of time that is independent of the component of the device. Third, the generation of a low DC power supply without using a transformer and without power resistor provides an AC/DC converter that is physically small and cheap. Fourth, a zero volt commutation of the starter allows a much longer lasting of the starter and the lamp.

Figure 4:
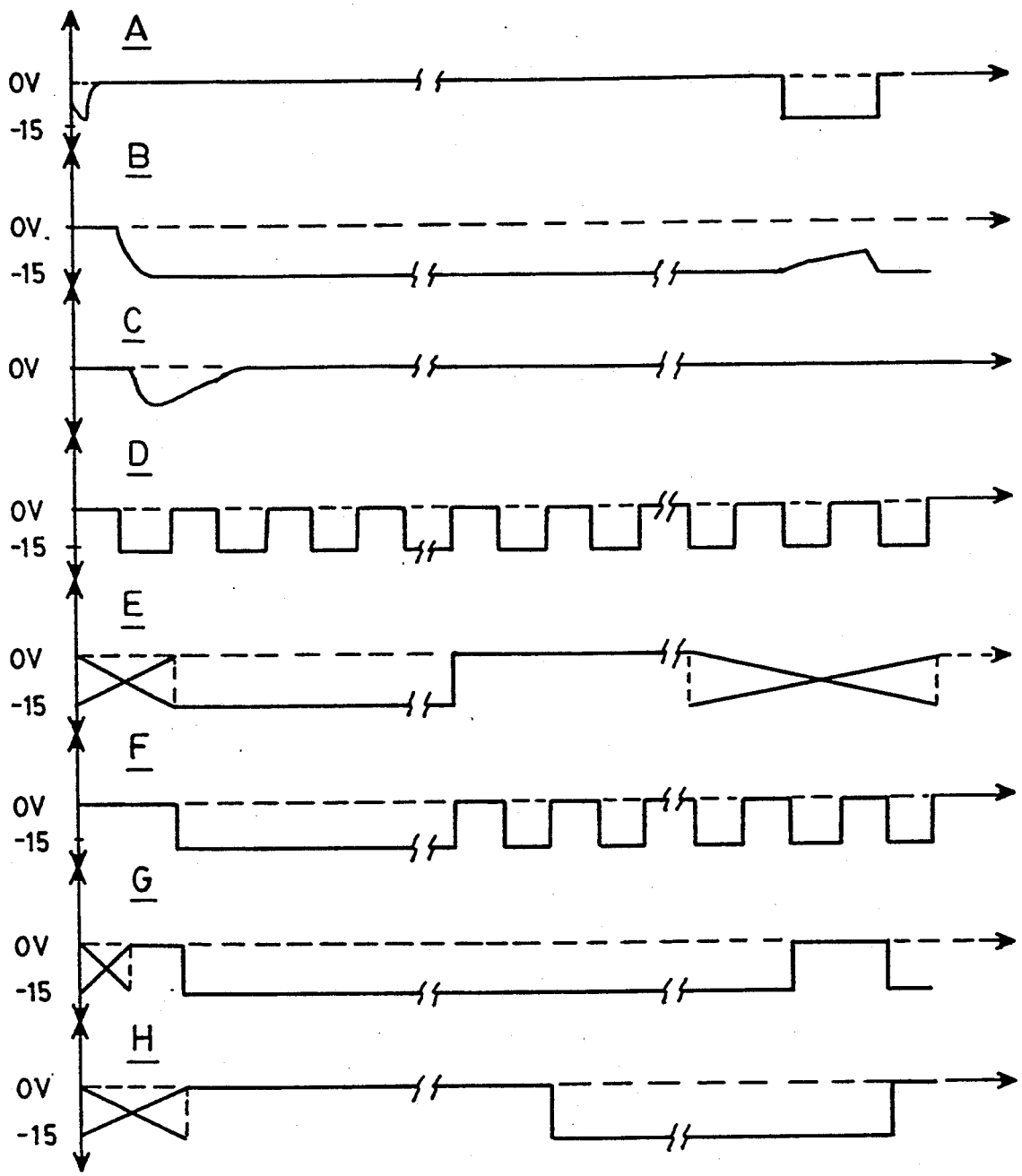
FIG. 4 illustrates different voltage signals appearing at different points of the circuit shown on FIG. 3, versus time.

Referring now to FIG. 4, there is shown different voltage signals appearing at different points of the circuit shown on FIG. 3 when it is in operation.

In FIG. 4A, there is shown the voltage appearing at the collector of the transistor 22. In FIG. 4B, there is shown the voltage appearing across the Zener diode 52. In FIG. 4C, there is shown the voltage appearing across the resistor 62. In FIG. 4D, there is shown the voltage appearing at the output of the flip-flop 70.

In FIG. 4E, there is shown the voltage appearing at the output of the counter 72. In FIG. 4F, there is shown the voltage appearing at the output of the NAND gate 74. In FIG. 4G there is shown the voltage appearing at the output of the NAND gate 64. In FIG. 4H, there is shown the voltage appearing at the output of the flip-flop 66.

| Element Number Number | Type of Element | Designation or value |
|---|---|---|
| 20 | Resistor | 510 K |
| 24,32,34 | Resistor | 68 K |
| 50 | Resistor | 1.2 M |
| 54,56,58,85 | Resistor | 270 ohms |
| 28,62 | Resistor | 33 K |
| 82 | Resistor | 1.5 K |
| 52 | Zener diode | IN4744A |
| 18,38,48 | Capacitor | .047 F |
| 44 | Capacitor | 47 F |
| 46 | Capacitor | 4.7 F |
| 60,26,76,86,78 | Capacitor | 6.8 nF |
| 16,25,30,36,42 | Diode | IN4004A |
| 22 | PNP Transistor | 2N3906 |
| 40 | SCR | 2N5064 |
| 8 | Triac | L201E3 |
| 64,68,74 | CMOS IC,Quad 2-input "Nand" Schmitt trigger | 4093 |
| 72 | CMOS IC,14-bit binary counter | 4020 |
| 66,70 | CMOS IC, Dual type D Flip-Flop | 4013 |
| 80 | Zero voltage crossing Optically isolated triac driver | MOC3031 |

Although the present invention has been explained hereinabove by way of a preferred embodiment thereof, it should be pointed out that any modifications to this preferred embodiment within the scope of the appended claims is not deemed to alter or change the nature and scope of the present invention.

The embodiments of the invention in which an exclusive property or privilege is claimed are defined as follows:

1. A starting and operating device for controlling a starter that ignites a sodium lamp, AC power voltage being provided to said starter and sodium lamp by means of a power supply transformer having its secondary winding connected to said starter and sodium lamp, and its primary winding connected to an AC power source, said device comprises:

an AC/DC converter connected to said primary winding for converting AC voltage into a low DC voltage;

a high power disabling means for disabling said starter;

an optor-isolator connected to said high power disabling means for controlling said high power disabling means by means of a low DC signal, and for electrically isolating said high power disabling means;

a timer connected to said opto-isolator for generating said low DC signal after passage of a predetermined amount of time to disable said starter; and a first delay circuit connected to said AC/DC converter for detecting energizing of said AC/DC converter, and for generating a delayed resetting signal for said timer after detection of said energizing whereby said AC/DC converter can be stabilized before resetting said timer.

2. A device according to claim 1, further comprising a second delay circuit having an input connected to said primary winding for detecting a temporary failure of the AC power source, and an output connected to said timer for generating a delayed resetting signal after that said temporary failure is detected.

3. A device according to claim 1, wherein said AC/DC converter comprises a SCR device that is triggered only during a portion of the alternation of the AC voltage to rectify and lower said AC voltage; and a resistor connected to a capacitor and a zener diode for regulating and generating said low DC voltage from the rectified and lowered AC voltage.

4. A device according to claim 1, wherein said first delay circuit has an input connected to an output of the AC/DC converter, and an output connected to said timer for generating said delayed resetting signal after a predetermined time delay triggered by said energizing of said AC/DC converter, said predetermined time delay being set by a resistor and a capacitor.

5. A device according to claim 2, wherein said second delay circuit comprises, connected in series, a capacitor, a first resistor and a first diode, which are connected to said primary winding; said second delay circuit also comprises, connected in series, a second resistor, a second diode and an emitter-to-base-junction of a transistor, which are connected in parallel to said capacitor, wherein, when the AC power source is normally operated, said capacitor is charged and said transistor is conducting, but when there is a temporary failure of the AC power source, said capacitor is sequentially discharged and charged so that said transistor is temporarily blocked and said delay resetting signal is sent to said timer.

* * * * *